US011035352B2

(12) United States Patent
Ventrapragada

(10) Patent No.: US 11,035,352 B2
(45) Date of Patent: Jun. 15, 2021

(54) METHOD AND SYSTEM FOR ENHANCING PERFORMANCE IN A RECIPROCATING COMPRESSOR

(71) Applicant: KONINKLIJKE PHILIPS N.V., Eindhoven (NL)

(72) Inventor: Varaprasad Ventrapragada, Marietta, GA (US)

(73) Assignee: Koninklijke Philips N.V., Eindhoven (NL)

( * ) Notice: Subject to any disclaimer, the term of this patent is extended or adjusted under 35 U.S.C. 154(b) by 298 days.

(21) Appl. No.: 15/571,305

(22) PCT Filed: May 3, 2016

(86) PCT No.: PCT/EP2016/059905
§ 371 (c)(1),
(2) Date: Nov. 2, 2017

(87) PCT Pub. No.: WO2016/177739
PCT Pub. Date: Nov. 10, 2016

(65) Prior Publication Data

US 2018/0355857 A1 Dec. 13, 2018

Related U.S. Application Data

(60) Provisional application No. 62/157,183, filed on May 5, 2015.

(51) Int. Cl.
*F04B 27/00* (2006.01)
*F04B 39/00* (2006.01)
(Continued)

(52) U.S. Cl.
CPC ..... *F04B 27/005* (2013.01); *F04B 39/0016* (2013.01); *F04B 39/10* (2013.01); *F04B 39/1073* (2013.01); *F04B 39/14* (2013.01)

(58) Field of Classification Search
CPC .... F04B 39/0016; F04B 27/005; F04B 39/10; F04B 39/1073; F04B 39/14; F04B 39/0005
(Continued)

(56) References Cited

U.S. PATENT DOCUMENTS 83,739 A * 11/1868 Stebbins ..... F04B 39/0016 417/549
5,655,887 A * 8/1997 Chou ..... F04B 35/04 417/415
(Continued)

FOREIGN PATENT DOCUMENTS

DE 202006005954 U1 6/2006
JP 2012251454 A 12/2012
WO WO2013091218 A1 6/2013

*Primary Examiner* — Philip E Stimpert
(74) *Attorney, Agent, or Firm* — Daniel H. Brean

(57) ABSTRACT

Systems and methods for enhancing performance in a reciprocating compressor are described. The compressor includes a cylinder, a crank shaft housing, a crank shaft, a motor, a motor housing and rod assembly. The rod assembly includes a coupling rod portion, a head portion, a cup seal, a cap and one or more valves. The rod assembly is configured to reciprocate within the cylinder so as to compress fluid within a space formed by the cylinder. The rod assembly is driven by the crank shaft. The one or more valves are configured to control air to the compressor. The one or more valves are removably coupled to the head portion, such that the one or more valves remain coupled to the head portion when the cap is detached from the coupling rod assembly.

18 Claims, 6 Drawing Sheets

(51) Int. Cl.
*F04B 39/10* (2006.01)
*F04B 39/14* (2006.01)

(58) Field of Classification Search
USPC ..... 417/545, 546, 550
See application file for complete search history.

(56) References Cited

U.S. PATENT DOCUMENTS

| | | | | |
|---|---|---|---|---|
| 6,193,482 | B1 | 2/2001 | Chen | |
| 6,279,421 | B1 * | 8/2001 | Faulkner | F04B 39/0005 74/579 R |
| 8,136,441 | B2 | 3/2012 | Darbois | |
| 2006/0260800 | A1 | 11/2006 | Bertane | |
| 2006/0275160 | A1 | 12/2006 | Leu | |
| 2007/0209626 | A1 * | 9/2007 | Chen | F04B 39/0005 123/193.1 |
| 2014/0314593 | A1 * | 10/2014 | Lin | F04B 1/0404 417/415 |

* cited by examiner

METHOD AND SYSTEM FOR ENHANCING PERFORMANCE IN A RECIPROCATING COMPRESSOR

CROSS-REFERENCE TO RELATED APPLICATIONS

This patent application claims the priority benefit under 35 U.S.C. § 371 of international patent application no. PCT/EP2016/059905, file May 6, 2016, which claims the priority benefit under 35 U.S.C. § 119(e) of U.S. Provisional Application No. 62/157,183, filed on May 5, 2015, the contents of which are herein incorporated by reference.

BACKGROUND OF THE INVENTION

1. Field of the Invention

The present disclosure pertains to methods and systems for enhancing performance in a reciprocating compressor.

2. Description of the Related Art

Typically, a compressor receives a supply of fluid, such as a liquid or gas, at a first pressure and increases the pressure of the fluid by forcing a given quantity of the received fluid having a first volume into a smaller second volume using a piston. Some compressors have a reciprocating piston that reciprocates within the cylinder to compress the fluid. The piston includes a reciprocating rod assembly. The rod assembly may be coupled to a crank shaft housed in a crank shaft housing. The crank shaft may be operated by a motor housed in a motor housing. Typical rod assemblies include input and output valves to intake and exhaust the fluid. The rod assembly may include a cup seal to provide a seal between the pressurized and non-pressurized sides of the rod assembly. The cup seal flexes during movement of the rod assembly within the cylinder and the frictional engagement creates wear on the cup seal. The cup seal is expected to wear over time due to pressurization of gas on the pressurized side of the rod assembly, the frictional engagement of the cup seal with the cylinder, and/or other operating conditions in the compressor. As a result, performance of the compressor may diminish because of the loss of contact between the cup seal and the cylinder which may require a cup seal replacement.

In current practice, the replacement of the cup seal requires removing multiple screws on the reciprocating rod assembly to disassemble and replace the cup seal. This process includes removing valves as well. The valve alignment is usually needed for performance and long term life of the compressor. In the event there are reassembly errors, such as bending of valve or misalignment can result in compromised compressor performance (fluid flow, pressure, clearance volume, noise, etc.) and/or reduction in valve life. These factors may make service/replacement of cup seal labor intensive and/ or expansive.

SUMMARY OF THE INVENTION

Accordingly, one or more aspects of the present disclosure relate to a system configured to enhance performance in a reciprocating compressor. The compressor includes a first cylinder that forms a first space for compressing a fluid; a first crank shaft housing operatively coupled with the first cylinder; a first crank shaft housed within the first crank shaft housing; a motor housing operatively coupled with the first crank shaft housing; a motor housed within the motor housing and configured to drive the first crank shaft; and a first rod assembly configured to reciprocate within the first cylinder so as to compress the fluid within the first space, and is configured to be driven by the first crank shaft. The first rod assembly includes a first connecting rod portion configured to couple the first rod assembly to the first crank shaft; a first head portion operatively coupled to the first coupling rod; a first cup seal configured to provide a movable seal between the first cylinder and the first rod assembly; a first cap removably coupled with the first rod assembly and configured to hold the cup seal in place on the first head portion; and one or more valves configured to control air across the head portion. The one or more valves are removably coupled to the first head portion. The one or more valves are constructed and arranged to remain coupled to the first head portion when the first cap is detached from the first rod assembly.

Another aspect of the present disclosure relates to a method for enhancing performance in a reciprocating compressor. The compressor includes a first cylinder, a first crank shaft housing, a first crank shaft, a motor housing, a motor, and a first rod assembly. The first rod assembly includes a first connecting rod portion, a first head portion, a first cup seal, a first cap, and one or more valves. The method includes forming, with the first cylinder, a first space for compressing a fluid; operatively coupling the first crank shaft housing with the first cylinder; housing the first crank shaft within the first crank shaft housing; operatively coupling the motor housing with the first crank shaft housing; housing the motor within the motor housing, the motor being configured to drive the first crank shaft; reciprocating the first rod assembly within the first cylinder so as to compress the fluid within the first space, the first rod assembly being driven by the first crank shaft; coupling, with the first connecting rod portion, the first rod assembly to the first crank shaft; operatively coupling the first head portion to the first connecting rod; providing, with the first cup seal a movable seal between the first cylinder and the first rod assembly; holding, with the first cap, the cup seal in place on the first head portion; and controlling air across the head portion, with the one or more valves, the one or more valves constructed and arranged to remain coupled to the first head portion when the first cap is detached from the first connecting rod assembly.

Still another aspect of the present disclosure relates to a system configured to enhance performance in a reciprocating compressor. The system includes first means for forming a first space for compressing a fluid; first means for housing a crank shaft operatively coupled with the first means for forming a first space; means for housing a motor for driving the crank shaft such that the means for housing the means for driving are operatively coupled with the first means for housing the crank shaft ; and first means for reciprocating within the first means for forming a first space so as to compress the fluid within the first space and such that the means for reciprocating are driven by the crankshaft. The first means for reciprocating includes first means for coupling the first means for reciprocating to the crankshaft; first means for forming a head portion of the first means for reciprocating operatively coupled to the first means for reciprocating; first means for providing a movable seal between the first means for forming a first space and the first means for reciprocating; first means for holding the cup seal in place on the first means for forming a head portion; and first means for controlling air across the head portion, the first means for controlling air being removably coupled to the first means for forming a head portion, the first means for controlling air constructed and arranged to remain coupled to the first means for forming a head portion when the first means for holding is detached from the first means for reciprocating.

These and other objects, features, and characteristics of the present disclosure, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure.

DETAILED DESCRIPTION OF EXEMPLARY EMBODIMENTS

Figure 1:
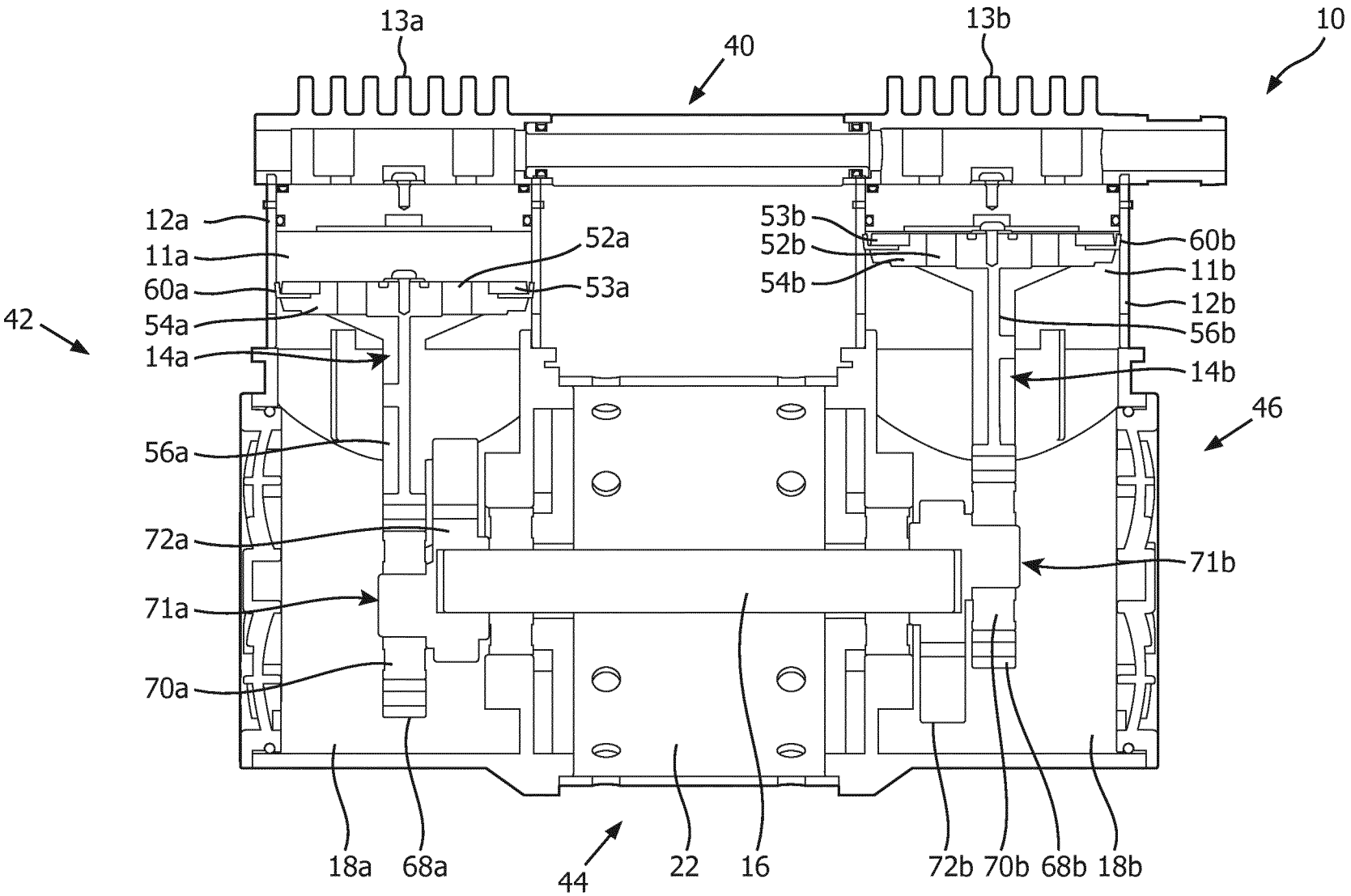
FIG. 1 is a schematic illustration of a cross-sectional view of a compressor.

As used herein, the singular form of "a", "an", and "the" include plural references unless the context clearly dictates otherwise. As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other.

As used herein, the word "unitary" means a component is created as a single piece or unit. That is, a component that includes pieces that are created separately and then coupled together as a unit is not a "unitary" component or body. As employed herein, the statement that two or more parts or components "engage" one another shall mean that the parts exert a force against one another either directly or through one or more intermediate parts or components. As employed herein, the term "number" shall mean one or an integer greater than one (i.e., a plurality).

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

FIG. 1 illustrates a compressor 10. In some embodiments, compressor 10 includes cylinders 12*a*, 12*b* (two are shown in this embodiment) for compressing a fluid, such as a liquid or gas, rod assemblies 14*a*, 14*b*, crank shafts 72*a*, 72*b*, and/or other components. Rod assemblies 14*a*, 14*b* are configured to reciprocate in cylinders 12*a*, 12*b*, respectively, so as to compress the fluid. Crank shafts 72*a* and 72*b* are configured to drive the rod assemblies 14*a* and 14*b* within cylinders 12*a* and 12*b* respectively. Rod assemblies 14*a* and 14*b* include one or more valves 52*a* and 52*b* and cup seals 60*a* and 60*b* (described herein). Compressor 10 may be configured to reduce the possibility of damage and/or misalignment to the valves in the compressor when a cup seal needs replacement. The configuration of compressor 10 may help minimize overall replacement time of the cup seal, minimize costs associated with replacing the cup seal, enhance volume clearance in compressor 10, and reduce noise of compressor 10. Volume clearance is the space remaining within cylinders 12*a* and 12*b* when the rod assemblies 14*a* and 14*b* are at the most advanced position in their travel within cylinders 12*a* and 12*b*. Managing clearance volume may enhance the compressor's performance. Compressor 10 may be used in oil-less applications where service is performed to replace worn-out cup seals after a given number of hours of operation (e.g., medical oxygen concentrator compressors) and/or in other applications.

First crank shaft housing 18*a* encloses first crank shaft 72*a*, is operatively coupled to first rod assembly 14*a*, and is configured to drive first rod assembly 14*a*. In some embodiments first crank shaft 72*a* is operatively coupled with motor shaft 16 that provides torsional energy from the motor (not shown) housed within motor housing 22. As illustrated in FIG. 1, motor shaft 16 is operatively coupled with second crank shaft 72*b* housed within second crank shaft housing 18*b* located at third side 44 along fourth side 46 of compressor assembly 10.

Second crank shaft 72*b* is configured to drive second rod assembly 14*b* to compress gas within second reciprocating space 11*b*. Second space 11*b* is defined by second rod assembly 14*b*, second cylinder 12*b*, and second cap seal 13*b* on along fourth side 46 of compressor assembly 10. The components along fourth side 46 of compressor assembly 10 may be the same and/or similar to the components located along second side 42 of the compressor assembly 10. For example, first cap seal 13*a* located along second side 42 may be the same and/or similar to second cap seal 60*b* located along fourth side 46.

In some embodiments, compressor 10 has a tandem arrangement with two cylinders 12*a*, 12*b*, having a rod assembly 14*a*, 14*b* received therein. A motor shaft 16 is configured to couple the motor to crankshafts 72*a* and 72*b*, which are coupled with one of the two rod assemblies 14*a*, 14*b*, so that the movement of the rod assemblies 14*a*, 14*b* oppose each other. However, this embodiment is not intended to be limiting, and it is contemplated that the compressor 10 may have other arrangements and numbers of cylinders 12*a*, 12*b*. For example, compressor 10 may be of single or dual acting designs. Compressor 10 may also include more than two cylinders.

In some embodiments, rod assemblies 14*a* and 14*b* are configured to alternately reciprocate within cylinders 12*a* and 12*b* respectively so as to compress the fluid. Crank shafts 72*a* and 72*b* are configured to drive pistons 14*a*, 14*b* within cylinders 12*a* and 12*b*. In some embodiments, rod assemblies 14*a* and 14*b* are wobble (or WOB-L) rod assemblies. However it is contemplated that other types of rod assembly may be used. Crank shafts 72*a* and 72*b* are housed in crankcases or crank shaft housings 18*a*, 18*b* that are operatively coupled with cylinders 12*a*, 12*b*. In some embodiments, two crankcases 18*a*, 18*b* are provided. The crankcases 18*a*, 18*b* are associated with one of the cylinders 12*a*, 12*b*. A motor (not shown) is operatively coupled with the crank shafts 72*a* and 72*b* and is configured to drive the crank shafts 72*a* and 72*b*. The motor is housed in a motor housing 22 that is operatively coupled with crankcases 18*a*, 18*b*.

As shown in FIG. 1, rod assemblies 14*a* and 14*b* having lower ends 68*a* and 68*b* with bearing centers 71*a* and 71*b* configured to receive a portion of the crank shafts 72*a* and 72*b*. Crank shafts 72*a* and 72*b* are offset and not in linear correlation to the axis of motor shaft 16. In this configuration, motor shaft 16 and rod assemblies 14*a* and 14*b* are configured to be eccentric. The eccentric crank shafts 72*a* and 72*b* are connected to motor shaft 16 such that the axis defined by motor shaft 16 is offset from the axis defined by the center of the bearings.

Figure 2:
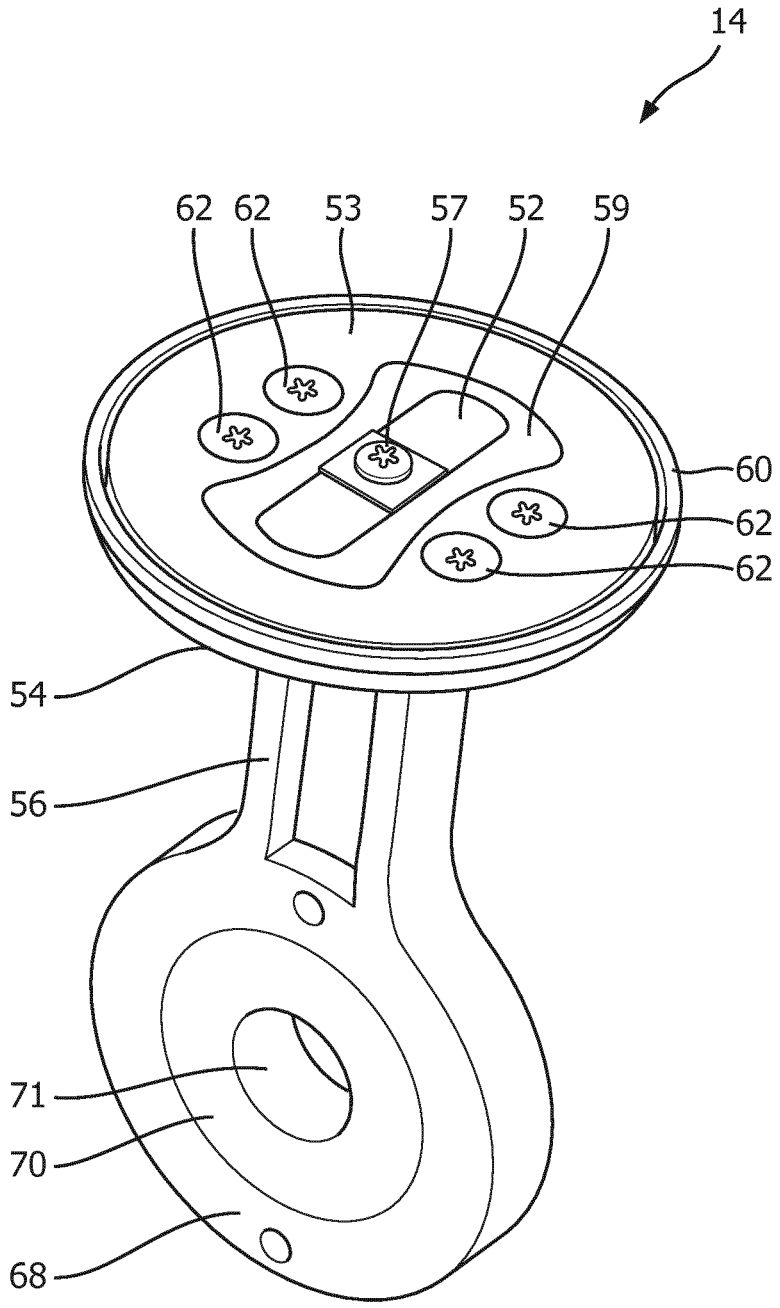
FIG. 2 illustrates an exemplary rod assembly, in accordance with one or more embodiments.

In some embodiments, motor housing 22 includes a motor (not shown) configured to drive crank shafts 72*a* and 72*b*. Motor shaft 16 rotates crank shafts 72*a* and 72*b*, which in turn causes rod assemblies 14*a* and 14*b*, to reciprocate upwardly and downwardly within cylinders 12*a*, 12*b*. This configuration enables rod assemblies 14*a* and 14*b* to tilt relative to cylinders 12*a*, 12*b* at all positions (except when rod assemblies 14*a* and 14*b* are positioned such that they are located nearest a first side 40 and a third side 44 of FIG. 1) due to the eccentricity of crank shaft 72. It is contemplated that crank shaft 72 does not need to be eccentric and may have other configurations or arrangements. As an example, rod assembly 14*a* shown in FIG. 2 is in the bottom most position and rod assembly 14*b* shown in FIG. 2 is in the top most position. This configuration of rod assemblies 14*a* and 14*ba* and 14*b* and crank shafts 72 converts the rotary energy from the motor (not shown) into linear motion of rod assemblies 14*a* and 14*ba*, 14*b* within cylinders 12*a*, 12*b*. This configuration enables compressor assembly 10 to increase the pressure of the fluid.

FIG. 2 illustrates an example of a rod assembly 14 that is similar to rod assemblies 14*a* and 14*b* described above, in accordance with one or more embodiments. Rod assembly 14 includes a connecting rod portion 56, a head portion 54, a cup seal 60, a cap 53, one or more valves 52, and/or other components. Connecting rod 56 has a lower end with a bearing 70. Bearing 70 has a center area 71 configured to receive a portion of a crank shaft (not shown in FIG. 2). Head portion 54 may be the same as and/or similar to head portions 54*a* and 54*b* described in FIG. 1. Head portion 54 is operatively coupled to connecting rod portion 56. In this embodiment, head portion 54 and connecting rod portion 56 are integral. In some embodiments, head portion 54 may be removably coupled to connecting rod portion 56, and/or head portion 54 and connecting rod portion 56 may be separate from each other in other embodiments. Head portion 54 and/or connecting rod portion 56 may be cast from a strong lightweight material such as aluminum alloy and/or formed in other ways with other materials. In some embodiments, head portion 54 and/or connecting rod portion 56 may be made of steel (e.g., for production engines), made of titanium for a combination of lightness with strength at higher cost (e.g., for high performance engines), cast iron for applications such as motor scooters, and/or a combination of other materials.

Figure 3:
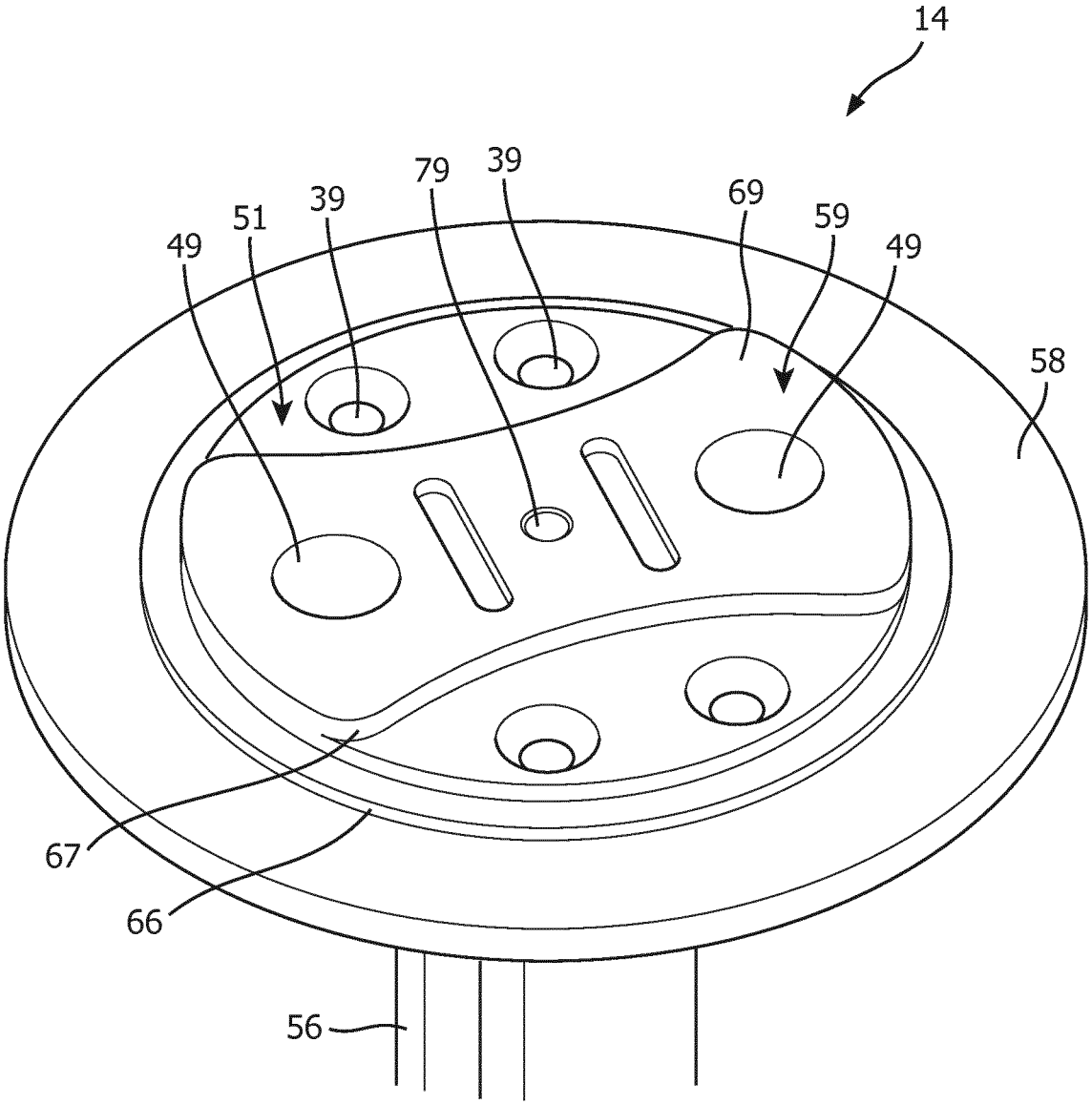
FIG. 3 illustrates an exemplary head portion of a rod assembly, in accordance with one or more embodiments.

FIG. 3 illustrates an exemplary head portion 54 of a rod assembly 14, in accordance with one or more embodiments. Head portion 54 shown in FIG. 3 may have a receiving surface 51 configured to receive a cup seal (not shown), receive other components of connecting rod assembly 56, and/or receive other components of compressor 10. Head portion 54 may have a flat substantially circular configuration with an annular groove 58 defined by an edge 66 of the head portion 54 for receiving the cup seal (described herein). Orifices 39 may be configured to receive one or more screws configured to couple a cap (described herein) with head portion 54, thereby coupling the cup seal with head portion 54. In some embodiments, the cup seal may be coupled with head portion 54 using a cap. The cap may be coupled with head portion using one or more screws, and/or other coupling devices. In some embodiments, head portion 54 may have an elevated portion 59, located on receiving surface 51 of head portion 54. Elevated portion 59 is defined by an edge 67 and a surface 69. Surface 69 may be configured such that one or more valves may be removably connected to elevated portion 59 at surface 69 of elevated portion 59. In some embodiments the one or more valves may be coupled to elevated portion 59 at surface 69 by one or more screws and/or other coupling mechanisms. For example, orifice 79 may be configured to receive a screw for coupling a valve to elevated portion 59 at surface 69. In some embodiments, orifices 49 located on elevated portion 59 may be configured to receive the one or more valves.

Elevated portion 59 may be of different sizes and shapes. In some embodiments, elevated portion 59 may be square shaped, annular shaped, kidney shaped, oval shaped, and/or other shapes. Elevated portion 59 may be of different sizes. For example, elevated portion may be of a size that will allow elevated portion 59 to receive one valve, or may be of a size that will allow elevated portion 59 to receive one or more valves and/or other components. In some embodiments, elevated portion 59 may be an integral part of head portion 54, may be coupled to head portion 54, or removably coupled with portion 54. In some embodiments, elevated portion 59 may be made of the same material as head portion 54, made of a different material, and/or a combination thereof.

Figure 4:
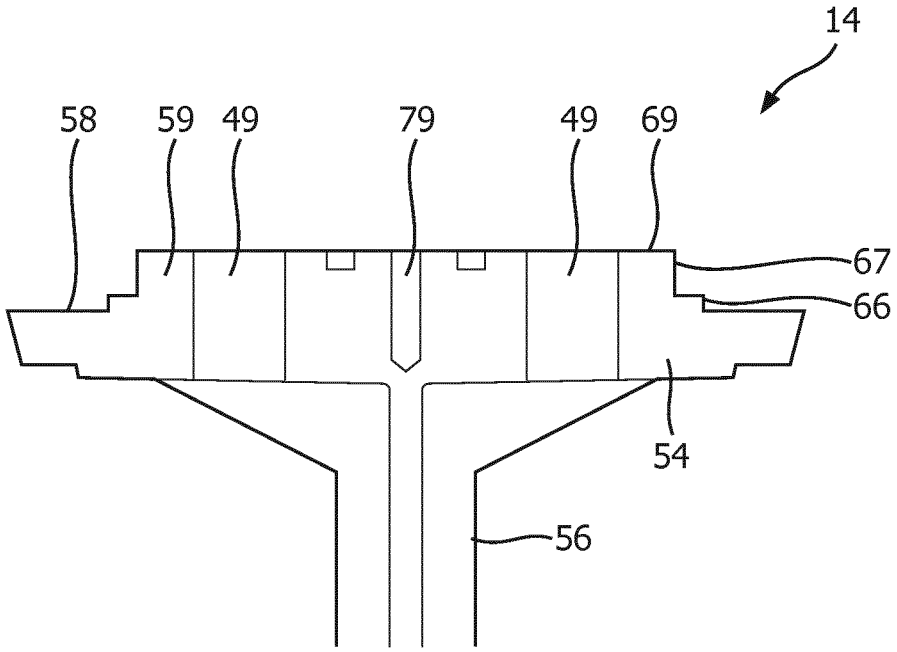
FIG. 4 illustrates an exemplary cross-sectional view of a head portion of a rod assembly, in accordance with one or more embodiments.

FIG. 4 is a cross sectional view of a rod assembly of compressor 10, in accordance with one or more embodiments. FIG. 4 shows connecting rod 56, head portion 54, groove 58, and elevated portion 59. As shown in FIG. 4, edge 66 defines groove 58 and elevated portion 59 is defined by surface 69 and edge 67. Orifices 49 for receiving one or more valves (not shown) and orifice 79 for receiving a coupling device (for example a screw) for securing the one or more valves on elevated portion 59 of head portion 54.

Figure 5:
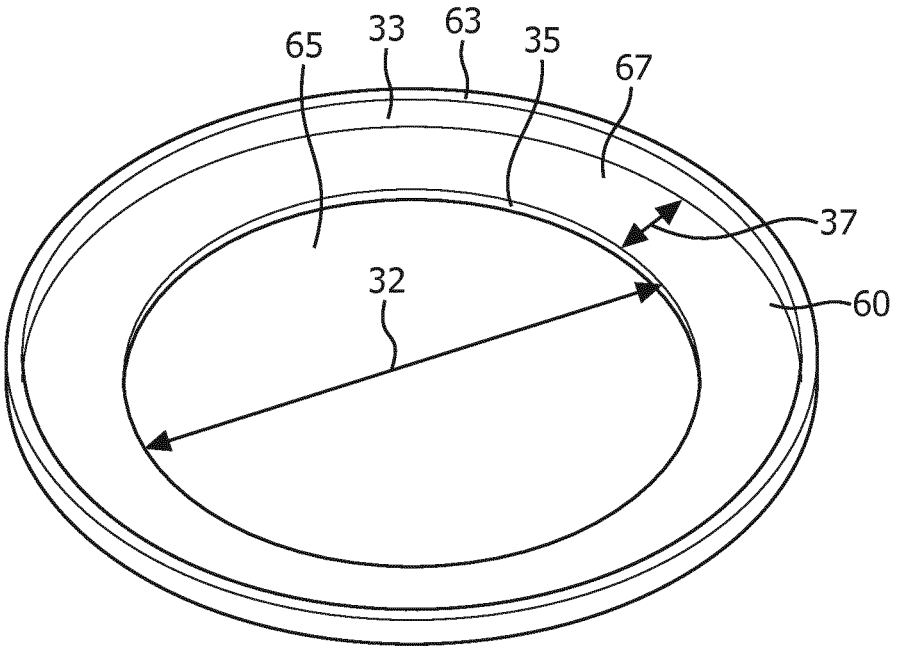
FIG. 5 illustrates an exemplary cup seal, in accordance with one or more embodiments.

Returning to FIG. 2, cup seal 60 is disposed on the head portion 54. Cup seal 60 is configured to provide a movable seal between first cylinder 12*a* and first rod assembly 14 described in FIG. 1. Cup seal 60 may have an outward bias relative to head portion 54 such that it compressively engages inner walls 13*a* of cylinder 12*a* (shown in FIG. 1), throughout rod assembly 14 strokes. Cup seal 60 may adopt an upwardly flexed position with respect to space 11*a* of cylinder 12*a*. An example of cup seal 60 is shown in FIG. 5. Cup seal 60 may be of annular shape with a hole 65, a lip 63, and groove 67. Dimensions of cup seal 60 may correspond to a compressor type of compressor 10, dimensions of head portion 54, dimensions of cap 53, and/or dimensions of other components of compressor 10. For example, a height 33 of lip 63, a width 37 of groove 67, a cup seal 60 thickness 35, a diameter 32 of hole 65, and or other dimensions of cup seal 60 may correspond to a type of compressor 10, dimensions of head portion 54, dimensions of cap 53, and/or dimensions of other components of compressor 10.

Cap 53 is removably coupled with rod assembly 14. Cap 53 is configured to hold cup seal 60 in place on head portion 54. One or more screws 62 may be used to secure cap 53 to head portion 54, thereby also retaining cup seal 60 within groove 58. In some embodiments, cap 53 may have a substantially circular configuration. In some embodiments, cap 53 may have different configurations and be formed indifferent shapes. In some embodiments, cap 53 may be configured to have a hole 19 to accommodate the shape of elevated portion 59 of head portion 54. Hole 19 is configured such that when cap 53 is placed on top of head 54, cap 53 engages head portion 54 such that elevated portion 59 is surrounded by cap 53.

Figure 6:
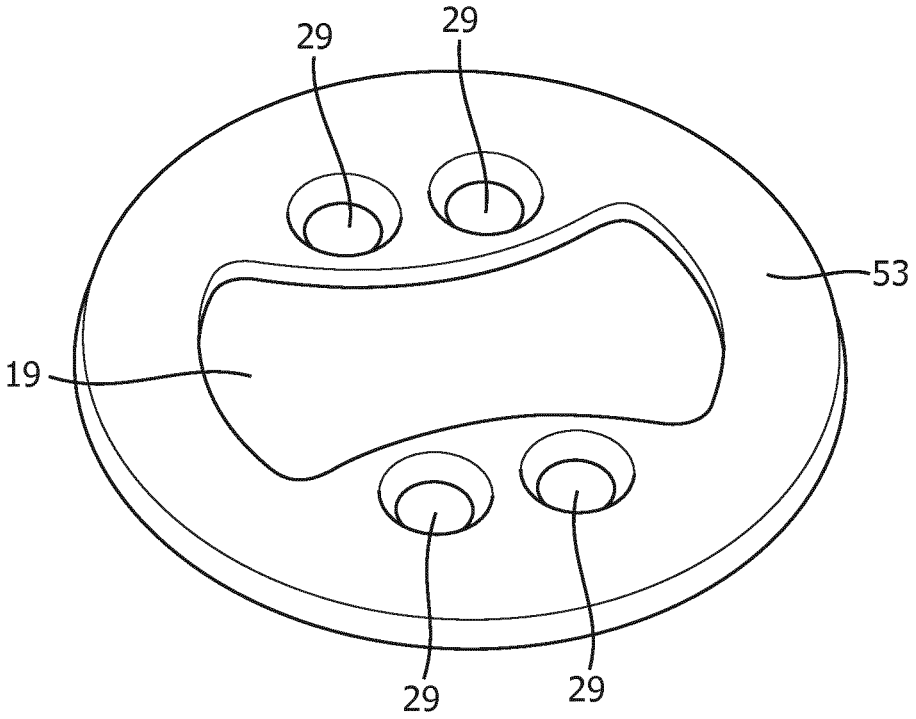
FIG. 6 illustrates an example of a cap, in accordance with one or more embodiments.
Figure 7:
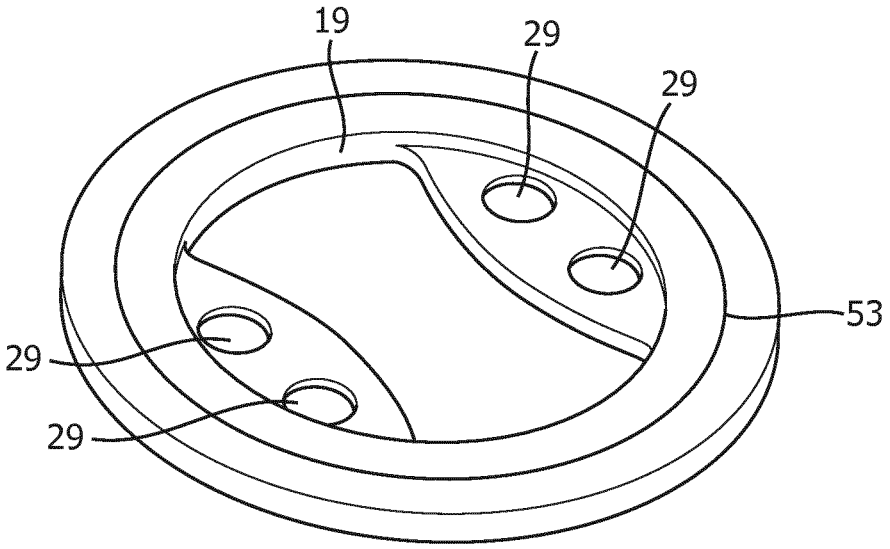
FIG. 7 illustrates another example of a cap, in accordance with one or more embodiments.

FIGS. 6 and 7 show examples of cap 53 according to one or more embodiments. In the examples shown in FIG. 6-7, cap 53 includes four holes 29 configured to receive four screws to be used to secure first cap 53 to head portion 54, thereby also retaining cup seal 60 within groove 58 of head portion 54 (described above). Also shown in FIGS. 6-7 is hole 19 configured to receive elevated portion 59 of head portion 54. Hole 19 may be of different sizes and shapes so as to accommodate elevated portion 59. For example, hole 19 of cap 53 may be square shaped, annular shaped, kidney shaped, oval shaped, and/or have other shapes.

Returning to FIG. 2, one or more valves 52 are configured to control air across the head portion 54. In some embodiments, the one or more valves 52 may be constructed and arranged such that the one or more valves 52 allow air through when rod assembly 14 is moving downwards. In some embodiments, the one or move valves 52 may be constructed and arranged such that the one or more valve 52 allow air through when rod assembly 14 is moving downwards, and/or in other directions. In some embodiments, the one or more valves may be removably coupled to head portion 54, such that the one or more valves remain coupled to head portion 54 when the cap 53 is detached from the connecting rod assembly 14 (e.g., when cup seal 60 needs to be replaced).

In some embodiments, the one or more valves 52 are removably coupled to the elevated portion 59 by one or more screws. In this example, screw 57 may be configured to be inserted through opening 79 (shown in FIG. 3) to couple the one or more valves 52 to head portion 54. In some embodiments, the one or more valves 52 may be removably coupled to the elevated portion 59 of head portion 54 by other coupling means.

Replacing cup seal 60*a*, for example, may be performed by removing screws (62 shown in FIG. 2), detaching cap 53*a* from head portion 54*a*, and removing cup seal from head portion 54*a*. The one or more valves 52*a* remain attached to head portion 54*a* while cup seal 60 is removed. A new cup seal 60*a* may be placed on head portion 54, and held down in place by cap 53*a* that will be coupled to head portion 54*a* using screws 62. The one or more valves remain attached to head portion 54*a* while the new cup seal 60 is put in place. A configuration of compressor 10 according to one or more embodiments may help reduce the possibility of damage and/or misalignment to the valves which may help reduce noise resulting from misaligned valves and helps managing volume clearance in compressor 10.

In some embodiments, instead of having an elevated portion 59, head portion 54 may have an indented portion. The indented portion may be configured to receive one or more valves such that the one or more valves remain attached to head portion 54 when cap 53 is detached from head portion 54. The indented portion of head portion 54 may be of different sizes and shapes. In some embodiments, the indented portion of head portion 54 may be square shaped, round shaped, annular shaped, kidney shaped, oval shaped, and/or other shapes. The indented portion of head portion 54 may be of different sizes. For example, the indented portion may be of a size that will allow it to receive one valve, or may be of a size that will allow it to receive one or more valves and/or other components.

Figure 8:
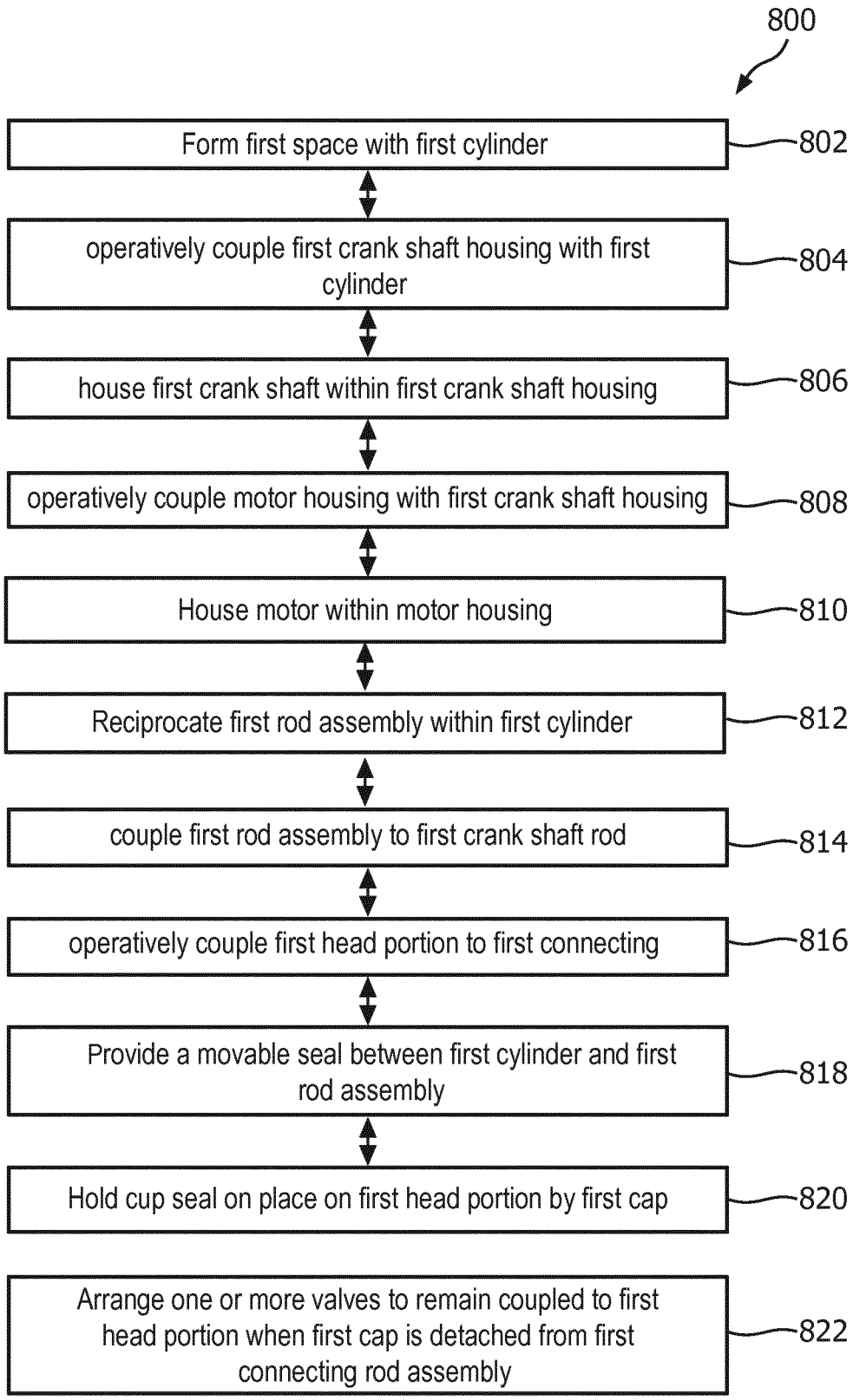
FIG. 8 illustrates a method for enhancing performance in a reciprocating compressor.

FIG. 8 illustrates a method 800 for increasing pressure of a fluid with a compressor. The compressor includes a first cylinder, a first crank shaft housing, a first crank shaft, a motor housing, a motor, and a first rod assembly, and/or other components. The first rod assembly includes a first connecting rod portion, a first head portion, a first cup seal, a first cap, one or more valves, and/or other components.

The operations of method 800 presented below are intended to be illustrative. In some embodiments, method 800 may be accomplished with one or more additional operations not described, and/or without one or more of the operations discussed. Additionally, the order in which the operations of method 800 are illustrated in FIG. 8 and described below is not intended to be limiting.

At an operation 802, a first space for compressing a fluid is formed with the first cylinder. In some embodiments, operation 802 is performed by a first cylinder the same as or similar to first cylinder 12*a* (shown in FIG. 1 and described herein).

At an operation 804, the first crank shaft housing is operatively coupled with the first cylinder. In some embodiments, operation 804 is performed by first crank shaft housing the same as or similar to connector (18*a*) (shown in FIG. 1 and described herein).

At an operation 806, the first crank shaft is housed within the first crank shaft housing. In some embodiments, operation 806 is performed by first crank shaft the same as or similar to first crank shaft 72*a* (shown in FIG. 1 and described herein).

At an operation 808, the motor housing is operatively coupled with the first crank shaft housing. In some embodiments, operation 808 is performed by a motor housing the same as or similar to motor housing 22 (shown in FIG. 1 and described herein).

At operation 810, the motor is housed within the motor housing. The motor is configured to drive the first crank shaft. In some embodiments, operation 810 is performed by a motor the same as or similar to motor 20 (shown in FIG. 1 and described herein).

At operation 812, the first rod assembly is reciprocated within the first cylinder so as to compress the fluid within the first space. The first rod assembly is driven by the first crank shaft. In some embodiments, operation 812 is performed by a first rod assembly the same as or similar to first rod assembly 14*a* (shown in FIG. 1 and described herein).

At operation 814, the first rod assembly is coupled to the first crank shaft with the first connecting rod portion. In some embodiments, operation 814 is performed by a first connecting rod portion the same as or similar to the first connecting rod portion 56*a* (shown in FIG. 1 and described herein).

At operation 816, the first head portion is operatively coupled to the first connecting rod. In some embodiments, operation 816 is performed by a first head portion the same as or similar to first head portion 54*a* (shown in FIG. 1 and described herein).

At operation 818, a movable seal is provided between the first cylinder and the first rod assembly by the first cup seal. In some embodiments, operation 818 is performed by a first cup seal the same as or similar to first cup seal 60*a* (shown in FIG. 1 and described herein).

At operation 820, the cup seal is held on place on the first head portion by the first cap. In some embodiments, operation 820 is performed by a first cap the same as or similar to first cap 53*a* (shown in FIG. 1 and described herein).

At operation 822, the one or more valves are constructed and arranged to remain coupled to the first head portion when the first cap is detached from the first connecting rod assembly. The one or more valves are configured to control air across the head portion. In some embodiments, operation 822 is performed by one or more valves the same as or similar to one or more valves 52*a* (shown in FIG. 1 and described herein).

In the claims, any reference signs placed between parentheses shall not be construed as limiting the claim. The word "comprising" or "including" does not exclude the presence of elements or steps other than those listed in a claim. In a device claim enumerating several means, several of these means may be embodied by one and the same item of hardware. The word "a" or "an" preceding an element does not exclude the presence of a plurality of such elements. In any device claim enumerating several means, several of these means may be embodied by one and the same item of hardware. The mere fact that certain elements are recited in mutually different dependent claims does not indicate that these elements cannot be used in combination.

Although the description provided above provides detail for the purpose of illustration based on what is currently considered to be the most practical and preferred embodiments, it is to be understood that such detail is solely for that purpose and that the disclosure is not limited to the expressly disclosed embodiments, but, on the contrary, is intended to cover modifications and equivalent arrangements that are within the spirit and scope of the appended claims. For example, it is to be understood that the present disclosure contemplates that, to the extent possible, one or more features of any embodiment can be combined with one or more features of any other embodiment.

What is claimed is:

1. A reciprocating compressor with enhanced performance, the compressor comprising:

a first cylinder forming a first space for compressing a fluid;

a first crank shaft housing operatively coupled with the first cylinder;

a first crank shaft housed within the first crank shaft housing;

a motor housing operatively coupled with the first crank shaft housing;

a motor housed within the motor housing, the motor being configured to drive the first crank shaft; and a first rod assembly configured to reciprocate within the first cylinder so as to compress the fluid within the first space, the first rod assembly being driven by the first crank shaft; wherein the first rod assembly comprises:

a first connecting rod portion configured to couple the first rod assembly to the first crank shaft, a first head portion operatively coupled to the first connecting rod, a first cup seal configured to provide a movable seal between the first cylinder and the first rod assembly, the first cup seal having an inner diameter, wherein the first cup seal is configured to be received on a first surface of the first head portion;

a first cap configured to hold the cup seal in place on the first head portion, the first cap comprising one or more coupling devices that removably couple the first cap to the first head portion, the one or more coupling devices being within the inner diameter of the first cup seal, wherein the first cap is configured to be received on the first surface of the first head portion; and one or more valves configured to control the fluid across the head portion, the one or more valves being removably coupled to first head portion, wherein the one or more valves are configured to be received on the first surface of the first head portion, the one or more valves constructed and arranged to remain coupled to the first head portion when the first cap is detached from the first connecting rod, the first cap further comprises one or more connecting regions configured to cooperate with the one or more coupling devices to removably couple the first cap to the first head portion, and the first cap is constructed and arranged to remain coupled to the first head portion when the one or more valves are detached from the first connecting rod.

2. The compressor of claim 1, wherein the first surface comprises a first elevated portion on the first surface such that the first elevated portion is configured to receive the one or more valves.

3. The compressor of claim 2, wherein the one or more valves are removably coupled to the elevated portion of the first surface of the first head portion.

4. The compressor of claim 2, wherein the first cap engages the first head portion such that the first elevated portion of the first surface of the first head portion is surrounded by the first cap.

5. The compressor of claim 1, further comprising:

a second cylinder that forms a second space for compressing the fluid;

a second crank shaft housing operatively coupled with the second cylinder and operatively coupled with motor housing;

a second crank shaft housed within the second crank shaft housing and configured to be driven by the motor; and a second rod assembly configured to reciprocate within the second cylinder so as to compress the fluid within the second space, the second rod assembly being driven by the second crank shaft; wherein the second rod assembly comprises:

a second connecting rod portion configured to couple the second rod assembly to the second crank shaft;

a second head portion operatively coupled to the second connecting rod;

a second cup seal configured to provide a movable seal between the second cylinder and the second rod assembly;

a second cap configured to hold the cup seal in place on the second head portion, the second cap comprising one or more second coupling devices that removably couple the second cap to the second head portion; and one or more valves configured to control the fluid across the head portion, the one or more valves being removably coupled to second head portion, the one or more valves constructed and arranged to remain coupled to the second head portion when the second cap is detached from the second connecting rod assembly.

6. The system of claim 1, wherein the one or more connecting regions comprises one or more orifices configured to receive corresponding one or more fasteners to removably couple the first cap to the first head portion.

7. A method to enhance performance in a reciprocating compressor, the compressor comprising a first cylinder, a first crank shaft housing, a first crank shaft, a motor housing, a motor, and a first rod assembly, the first rod assembly comprising a first connecting rod portion, a first head portion, a first cup seal having an inner diameter, a first cap, and one or more valves, the method comprising:

forming, with the first cylinder, a first space for compressing a fluid;

operatively coupling the first crank shaft housing with the first cylinder;

housing the first crank shaft within the first crank shaft housing;

operatively coupling the motor housing with the first crank shaft housing;

housing the motor within the motor housing, the motor being configured to drive the first crank shaft;

reciprocating the first rod assembly within the first cylinder so as to compress the fluid within the first space, the first rod assembly being driven by the first crank shaft;

coupling, with the first connecting rod portion, the first rod assembly to the first crank shaft;

operatively coupling the first head portion to the first connecting rod;

providing, with the first cup seal, a movable seal between the first cylinder and the first rod assembly, wherein the first cup seal is configured to be received on a first surface of the first head portion;

holding, with the first cap, the cup seal in place on the first head portion, the first cap comprising one or more coupling devices that removably couple the first cap to the first head portion, the one or more coupling devices being within the inner diameter of the first cup seal, wherein the first cap is configured to be received on the first surface of the first head portion; and controlling air across the head portion, with the one or more valves, the one or more valves constructed and arranged to remain coupled to the first head portion when the first cap is detached from the first connecting rod, wherein the one or more valves are configured to be received on the first surface of the first head portion, and wherein the first cap further comprises one or more connecting regions configured to cooperate with the one or more coupling devices to removably couple the first cap to the first head portion and wherein the first cap is constructed and arranged to remain coupled to the first head portion when the one or more valves are detached from the first connecting rod.

8. The method of claim 7, wherein the first surface comprises a first elevated portion on the first surface such that the first elevated portion is configured to receive the one or more valves.

9. The method of claim 8, wherein the one or more valves are removably coupled to the elevated portion of the first surface of the first head portion.

10. The method of claim 7, the first cap engages the first head portion such that the first elevated portion of the first surface of the first head portion is surrounded by the first cap.

11. The method of claim 7, wherein the compressor further comprises a second cylinder, a second crank shaft housing, a second crank shaft, and a second rod assembly, the second rod assembly comprising a second connecting rod portion, a second head portion, a second cup seal, a second cap, and one or more valves, the method further comprising:

forming, with the second cylinder, a second space for compressing the fluid;

operatively coupling the second crank shaft housing with the second cylinder;

housing the second crank shaft within the second crank shaft housing;

operatively coupling the motor housing with the second crank shaft housing such that the second crank shaft is driven by the motor;

reciprocating the second rod assembly within the second cylinder so as to compress the fluid within the second space, the second rod assembly being driven by the second crank shaft;

coupling, with the second connecting rod portion, the second rod assembly to the second crank shaft;

operatively coupling the second head portion to the second connecting rod;

providing, with the second cup seal a movable seal between the second cylinder and the second rod assembly;

holding, with the second cap, the cup seal in place on the second head portion, the second cap comprising one or more second coupling devices that removably couple the second cap to the second head portion; and controlling the fluid across the head portion, with the one or more valves, the one or more valves constructed and arranged to remain coupled to the second head portion when the second cap is detached from the second connecting rod assembly.

12. The method of claim 7, wherein the one or more connecting regions comprises one or more orifices configured to receive corresponding one or more fasteners to removably couple the first cap to the first head portion.

13. A system to enhance performance in a reciprocating compressor, the system comprising:

first means for forming a first space for compressing a fluid;

first means for housing a crank shaft operatively coupled with the first means for forming a first space;

means for housing a motor for driving the crank shaft, the means for housing the means for driving operatively coupled with the first means for housing the crank shaft; and first means for reciprocating within the first means for forming a first space so as to compress the fluid within the first space, the means for reciprocating being driven by the crankshaft, the first means for reciprocating comprising:

first means for coupling the first means for reciprocating to the crankshaft;

first means for forming a head portion of the first means for reciprocating operatively coupled to the first means for reciprocating;

first means for providing a movable seal between the first means for forming a first space and the first means for reciprocating, the first means for providing a movable seal having an inner diameter wherein the first means for providing a movable seal is configured to be received on a first surface of the first means for forming a head portion;

first means for holding the means for providing a movable seal in place on the first means for forming a head portion, wherein the first means for holding is configured to be received on the first surface of the first means for forming a head portion, the first means for holding the means for providing a movable seal in place comprising one or more coupling devices that removably couple the first means for holding the means for providing a movable seal in place to the first means for forming a head portion, the one or more coupling devices being within the inner diameter of the first cup seal; and first means for controlling air across the head portion, the first means for controlling air being removably coupled to the first means for forming a head portion, wherein the first means for controlling air are configured to be received on the first surface of the first means for forming a head portion, the first means for controlling air constructed and arranged to remain coupled to the first means for forming a head portion when the first means for holding is detached from the first means for reciprocating, wherein the first means for holding the means for providing a movable seal in place further comprises one or more connecting regions configured to cooperate with the one or more coupling devices to removably couple the first means for holding the means for providing a movable seal in place to the first means for forming a head portion and wherein the first means for holding the means for providing a movable seal in place is constructed and arranged to remain coupled to the first means for forming a head portion when the one or more valves are detached from the first connecting rod.

14. The system of claim 13, wherein the first surface comprises a first elevated portion on the first surface such that the elevated surface is configured to receive the first means for controlling air across the head portion.

15. The system of claim 14, wherein the first means for controlling air across the head portion is removably coupled to the first elevated portion of the first surface of the head portion.

16. The system of claim 14, wherein the first means for holding the means for providing a movable seal in place engages the head portion such that the first elevated portion of the first surface of the head portion is surrounded by the first means for holding the means for providing a movable seal in place.

17. The system of claim 13 further comprising:

second means for forming a second space for compressing the fluid;

second means for housing a crank shaft operatively coupled with the second means for forming a second space and operatively coupled with means for housing the motor for driving the crank shaft; and second means for reciprocating within the second means for forming a second space so as to compress the fluid within the second space, the means for reciprocating being driven by the crankshaft, the second means for reciprocating comprising:

second means for coupling the second means for reciprocating to the crankshaft;

second means for forming a head portion of the second means for reciprocating operatively coupled to the second means for reciprocating;

second means for providing a movable seal between the second means for forming a second space and the second means for reciprocating;

second means for holding the cup seal in place on the second means for forming a head portion, the second means for holding the cup seal in place comprising one or more second coupling devices that removably couple the second means for holding the cup seal in place to the second means for forming a head portion; and second means for controlling the fluid across the head portion, the second means for controlling air being removably coupled to the second means for forming a head portion, the second means for controlling air constructed and arranged to remain coupled to the second means for forming a head portion when the second means for holding is detached from the second means for reciprocating.

18. The system of claim 13, wherein the one or more connecting regions comprises one or more orifices configured to receive corresponding one or more fasteners to removably couple the first means for holding the cup seal in place to the first means for forming a head portion.

* * * * *